United States Patent [19]

Rose et al.

[11] Patent Number: 4,513,807

[45] Date of Patent: Apr. 30, 1985

[54] METHOD FOR MAKING A RADIAL FLOW CERAMIC ROTOR FOR ROTARY TYPE REGENERATOR HEAT EXCHANGE APPARATUS: AND ATTENDANT CERAMIC ROTOR CONSTRUCTIONS

[75] Inventors: Douglas N. Rose, Macomb; John E. Becker, Oakland, both of Mich.

[73] Assignee: The United States of America as represented by the Secretary of the Army, Washington, D.C.

[21] Appl. No.: 489,969

[22] Filed: Apr. 29, 1983

[51] Int. Cl.[3] ..... F28D 19/00

[52] U.S. Cl. ..... 165/10; 165/8; 65/33

[58] Field of Search ..... 165/10, 4, 8

[56] References Cited

U.S. PATENT DOCUMENTS

| | | | |
|---|---|---|---|
| 1,843,252 | 2/1932 | Toensfeldt | 165/8 |
| 2,552,937 | 5/1951 | Cohen | 165/10 |
| 2,978,227 | 4/1961 | Hess | 165/8 |
| 3,079,991 | 3/1963 | Evans et al. | 165/7 |
| 3,081,822 | 3/1963 | Wolansby et al. | 165/10 |
| 3,083,762 | 4/1963 | Kolthoff et al. | 165/8 |
| 3,112,184 | 11/1963 | Hollenbach | 165/10 |
| 3,216,487 | 11/1965 | Gallagher | 165/9 |
| 3,320,044 | 5/1967 | Cole et al. | 165/10 |
| 3,391,727 | 7/1968 | Topouzian | 165/10 |
| 3,444,925 | 5/1969 | Johnson | 165/10 |
| 4,310,046 | 1/1982 | Michalak | 165/5 |

*Primary Examiner*—Albert W. Davis, Jr.

*Attorney, Agent, or Firm*—Peter A. Taucher; Gail S. Soderling; Robert P. Gibson

[57] ABSTRACT

Novel methods for the continuous manufacturing of radial flow ceramic material rotor bodies for rotary type regenerator heat exchange apparatus, and novelly constructed rotor bodies made by and reflecting the characteristics of the novel methods.

The novel methods basically comprise preferably the continuous assembling of predetermined numbers of axially arranged, sequential, radially grooved layers of unfired ceramic media, with sequentially touching layers coacting to collectively form outwardly flaring fluid gas passageways, disposed in a 360° continuous radially oriented manner extending uniformly around the open center passageway through the rotor body. Respective steps of some of the novel methods include using tapered pairs of coacting corrugating rollers, and tapered pairs of groove-embossing rollers, both forms of which the apparatus and procedures collectively impart a spiral-like or helical path to the media material from which the rotor bodies are constructed, and thereafter continuously helically collecting the respective corrugated and grooved media alone or in combination with other media until a predetermined length of rotor body is built-up. The unfired assembled bodies are subsequently fired to achieve the finished hardness of usable rotor bodies. As a result of the firing step, the sequential body layers and any ancillary similar ceramic material components integrally fuse into basically a one piece rotor body which when in operative service is much better able to withstand rapidly fluctuating high temperature range changes with minimal distortion.

2 Claims, 18 Drawing Figures

FIG-1
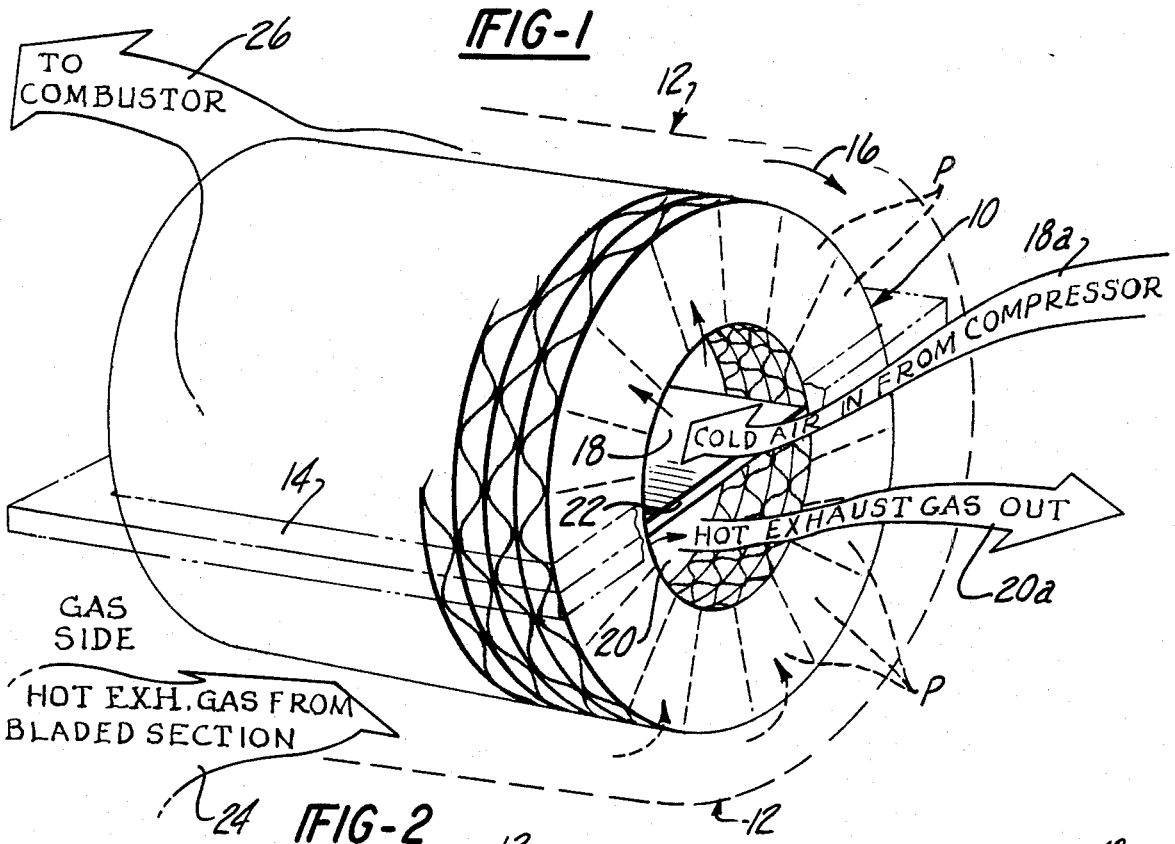
FIG-2
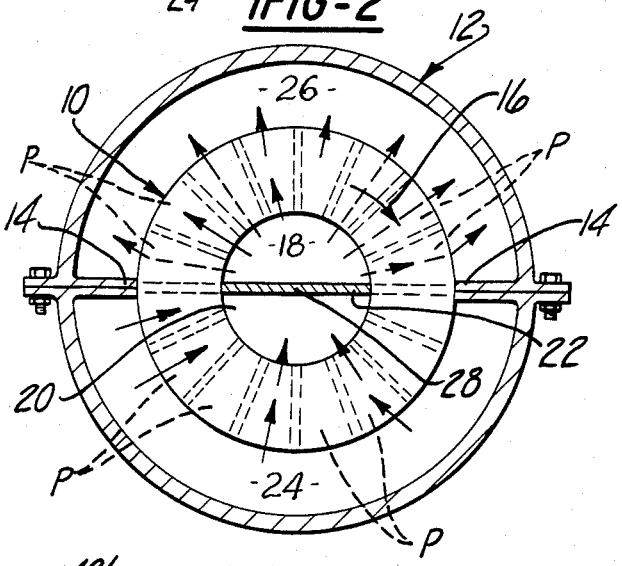
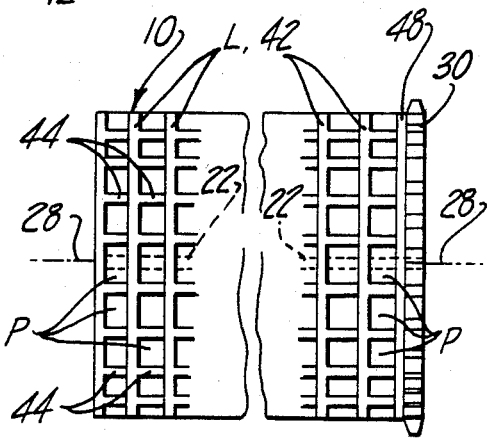
FIG-3
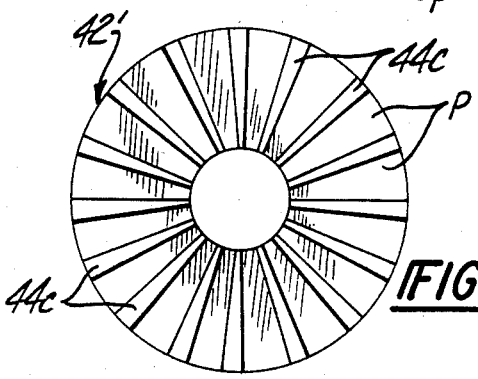
FIG-4
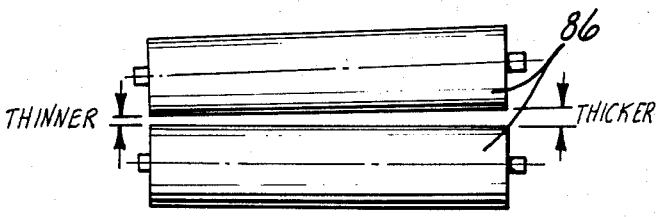
FIG-5

50
52
54
56
58
60
FASTEN DISCS INTO COIL
59
62
COATING
DRYING
64
61
H
SEE FIG. 8.
32
34
33
MIXER AND PRE-HEATER
36
40
EXTRUDER AND EMBOSSING
38
46
44
42
TO STACKING AND FIRING

FIRING OVEN
LOW ASH PAPER
SLURRY

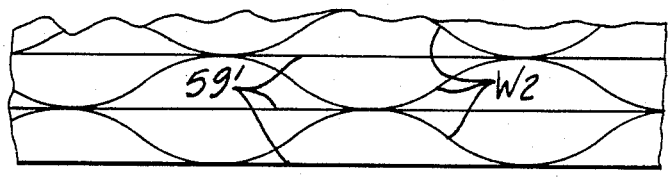
FIG-14
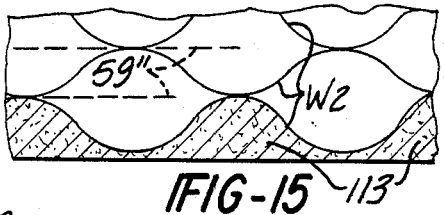
FIG-15
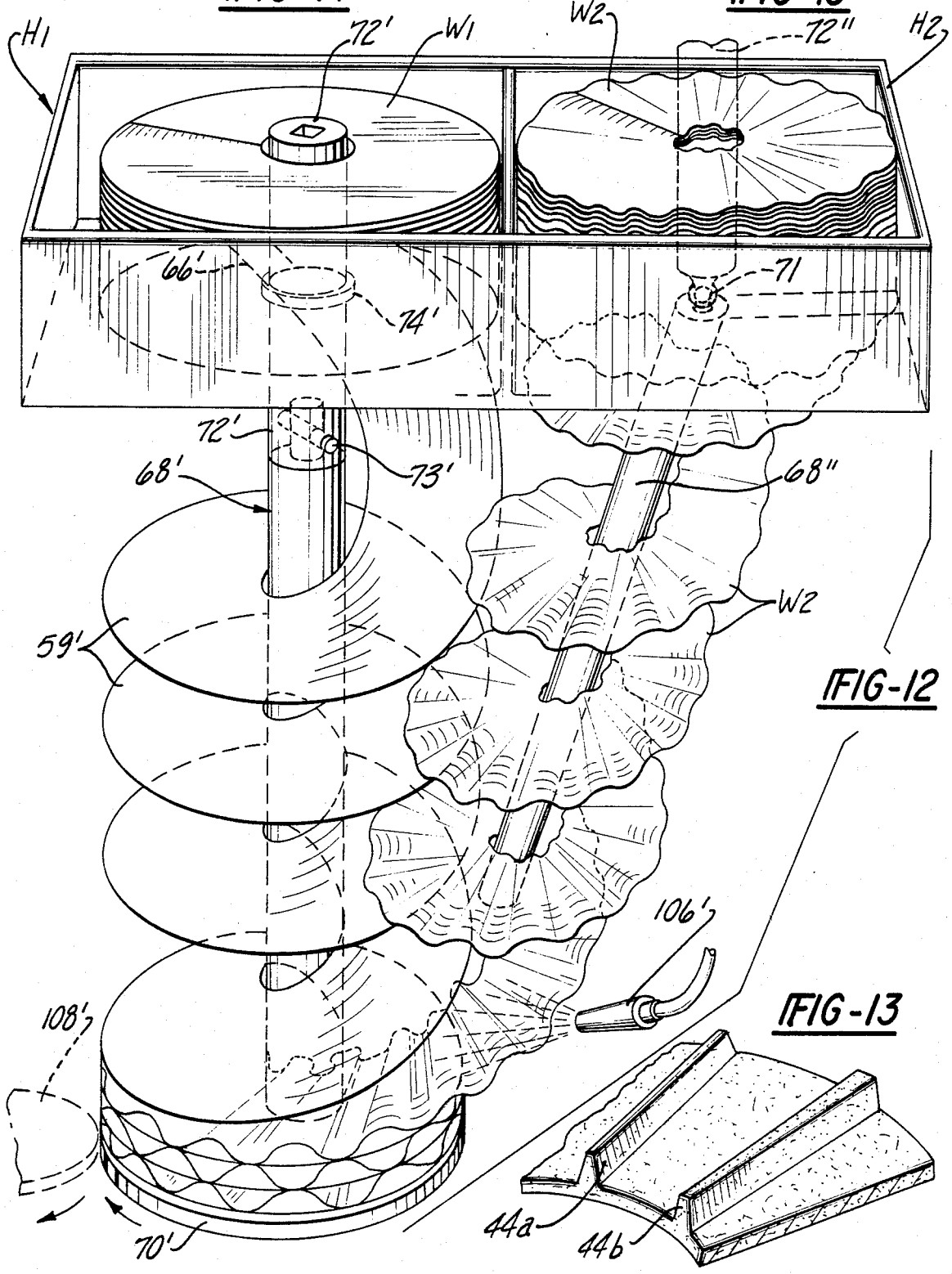
FIG-12
FIG-13

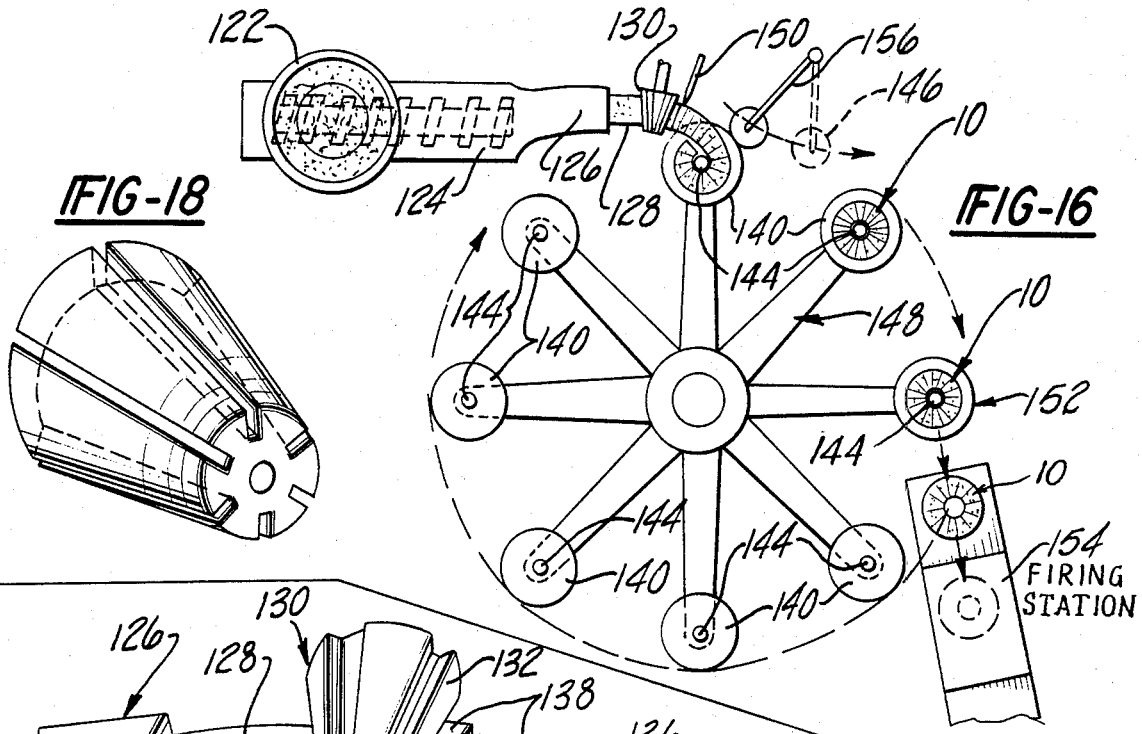
FIG-18
FIG-16
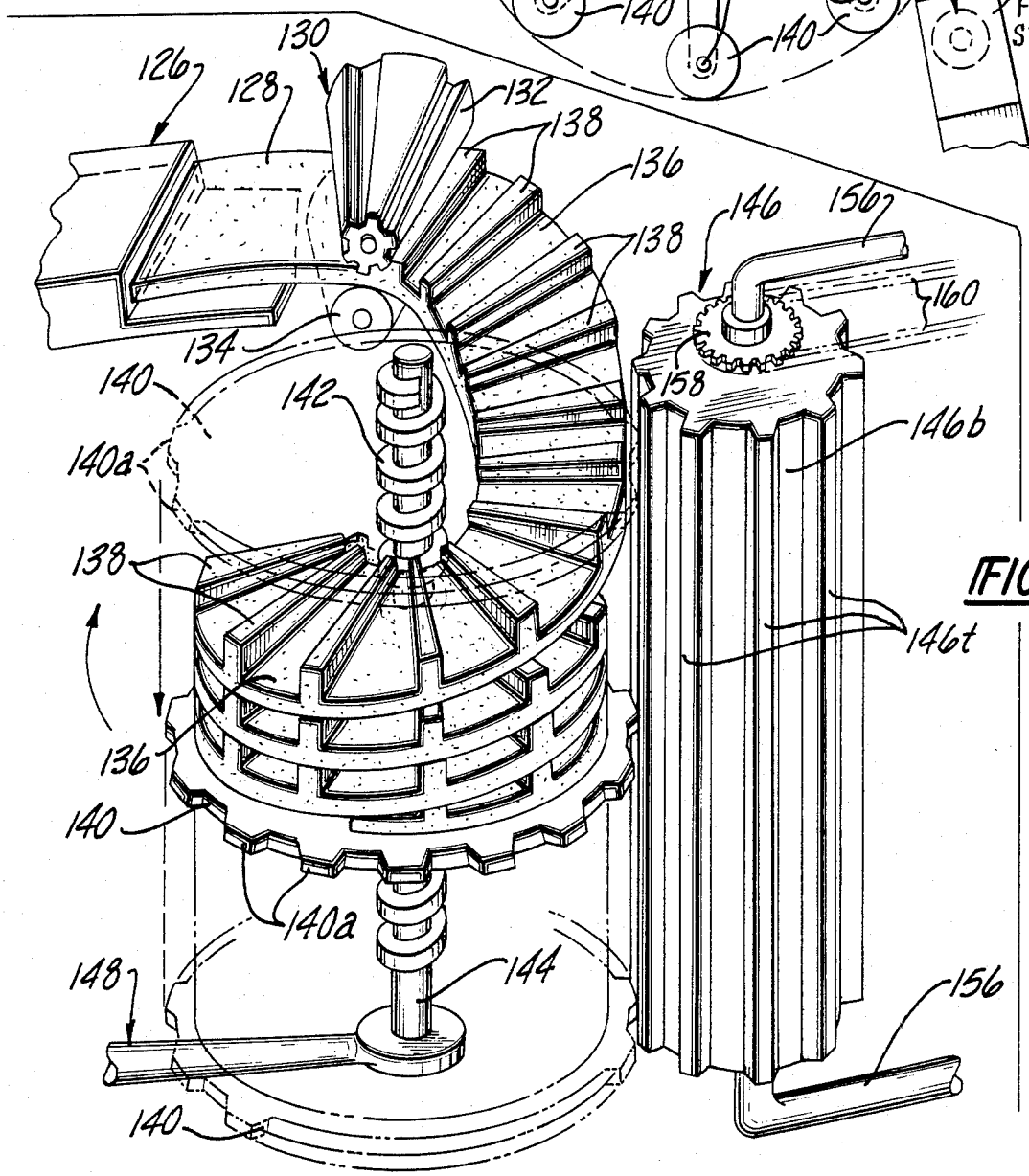
FIG-17

METHOD FOR MAKING A RADIAL FLOW CERAMIC ROTOR FOR ROTARY TYPE REGENERATOR HEAT EXCHANGE APPARATUS: AND ATTENDANT CERAMIC ROTOR CONSTRUCTIONS

GOVERNMENT INTEREST

The invention described herein may be manufactured, used, and licensed by or for the Government for governmental purposes without payment to us of any royalty thereon.

BACKGROUND OF INVENTION

The present invention relates generally to rotary type regenerative heat exchanger apparatus. More specifically, it relates to novel methods for manufacturing a ceramic material rotor body or heat wheel of the radial flow type for use with such regenerator apparatus. Additionally, the invention hereof relates to novelly improved constructional forms of rotor bodies made in accordance with the novel methods hereof.

Regenerator apparatus to which the present inventive features relate usually include housing apparatus divided by suitable internal partitions into respective high and low pressure gas chambers, frequently called the air side and gas side respectively, and further includes an open center or hollow cylindrical drum or rotor body having suitable heat transferring elements, rotatively supported within the housing, and rotatively driven by suitable means via intermediate connection with an output shaft of a turbine power plant with which the equipment may be associated. Heated gases, usually in the form of turbine exhaust gases at relatively low pressure, are introduced into the aforesaid so-called gas side of the regenerator where they give up or transfer their heat to the rotating drum or rotor body. The heated gases pass through the drum or rotor body in a radial direction from the gas side to the so-called air side where it gives up the heat (acquired from the exhaust gases) to the incoming air introduced into the inner air side, generally by means of an associated turbine driven compressor and at a pressure substantially higher than that in the gas side. From this regenerator apparatus, the newly introduced air is preheated and then is delivered to the combustion chamber.

Such regenerators or heat wheels are well known as rotary heat exchangers, and are used not only in association with turbine and other type engines, but in various other industrail processes. Ceramic materials are very attractive materials from which to make the rotor bodies or heat wheels because of their ability to withstand high temperatures, while having low thermal expansion, and further due to the relatively readily available and low cost raw materials.

PRIOR ART STRUCTURES

Some ceramic regenerators have been developed in the large wheel, drum or disc form with the gas flow being through passages parallel to the axis of wheel rotation, thus termed axial flow regenerators. Additionally, some lesser common generally non-ceramic forms of radial flow regenerators have evolved wherein the fluid gases are directed either radially inward or radially outward, such as the types disclosed in the following U.S. Pat. Nos.: 1,843,252 Feb. 2, 1932, Toensfeldt 2,978,227 Apr. 4, 1961, Hess 3,079,991 Mar. 5, 1963, Evans and Lyle 3,083,762 Apr. 2, 1963, Kolthoff and Jones 3,216,487 Nov. 9, 1965, Gallagher 4,310,046 Jan. 12, 1982, Michalak None of these prior patents anticipate or suggest the novel methods or improved constructional features disclosed in the present invention. Although U.S. Pat. Nos. 1,843,252 and 2,978,227 show early vintage radial forms utilizing circumferentially arranged corrugated panels, they are of light metallic form partially spot welded and partially bolted together, or otherwise comprise removable sector constructional features not of interest to the present invention. The remaining few radial flow type patents are of only general interest. They are even less relevant to the unique methods and unitarily fused end products claimed herein.

BRIEF SUMMARY AND OBJECTS OF THE INVENTION

The novel processes hereof lend themselves to the production of ceramic material radial flow regenerator rotors of the hollow cylindrical form in various sizes. The ability to manufacture them in smaller sizes can provide designers with greater flexibility in fitting the regenerator apparatus into presently available space in both aircraft and land vehicles, when made with relatively smaller frontal area, than are many of the prior art types, many of which are of the larger non-rotary, more bulky recuperator type.

The basic novel processes include utilizing media webs which are precoated and/or treated with a ceramic-binder media, or alternatively processing a mixture of ceramic-binder ingredients which transform into a generally semi-plastic deformable state and extruding it into predetermined size webs of ceramic media. According to this invention, the media webs for both basic processes prior to assembly are preshaped into flat, pronounced arcuate shapes, which for one process and form are of at least near circular precut form or otherwise suitably formed to be of generally low pitch helical character; and which media webs for another process and form are suitably preshaped as via dieforming into flat circular discs with open centers. Both embodiments are are further pre-shaped during the manufacturing processes so as to have radially outwardly flaring grooves which, when the media web materials are sequentially assembled as described, will provide a predetermined number of axially arranged sequential layers. These grooved layers collectively form a continuous plurality of radially directed outwardly flared, fluid-flow passageways which extend in a continuous 360° arrangement about a center axis and center gas fluid passageway. The unfired assemblies are then transferred to a suitable firing station where they are subjected to predetermined firing temperatures to achieve a unitarily fused, hardened, usable state.

Thus, as discernable from the foregoing basic process descriptions, the manufactured rotor bodies are either of continuous generally flat helical wound, sequential, corrugated layer character, formed into predetermined lengths of open-centered generally cylindrical form; or they are of the same general cylindrical character having predetermined lengths comprised of a predetermined number of sequentially arranged open-centered disc elements. Except for perhaps one end closure disc, the remaining disc elements are substantially identically pre-shaped as by die forming and embossing groove-forming ribs onto one side of the disc elements. The plurality of rib elements are equally spaced, radially extending and project axially, while maintaining not only a flat opposite face of each disc element, but also maintaining substantially the same axial rib height or projection at both the inner and outer radial edges. Both basic forms thus provide open centered, radial flow regenerator rotors in which the cross section of the respective radial flow gas passageways or channels increases from the inside to the outside diameter.

Thus, it is a principal object to evolve various processes to make rotor bodies for use where fluid-flow passageways are arranged to have an outer-to-inner general flow pattern whereby the exhaust gas is received in larger cross-sectional portions of the channels when it is hotter, which thereby means the flow in the passageway or channel can be of more uniform velocity as it passes through the gradually decreasing channel to smaller cross-sectional inner end while simultaneously giving up some of its heat. This arrangement should decrease the pressure drop within the regenerator apparatus and thus increase its efficiency.

Further objects of the invention are to disclose various novel methods of manufacturing the novel generic forms of ceramic material rotor bodies, as well as other novel specie forms. All forms utilize the radial flow principle and embody a tapered radial flow ceramic honeycomb gas passageway complex which in some forms not only has the widest portion of the tapered gas passages at the outer circumferential edge, with the narrowest portion being at the inner circumferential edge, but also utilizes radially differing thickness of the body layers and/or ribs.

Other objects and additional novel features hereof will become apparent from the appended claims, and from the ensuing detailed description taken in conjunction with the accompanying illustrative drawings whose respective drawing figures will now be briefly described.

BRIEF DESCRIPTION OF DRAWINGS

FIG. 1 is a perspective view of a radial flow rotor body made in accordance with the methods hereof, and shown in semi-schematic form with a fragmentary schematic regenerator housing apparatus and illustrative schematic counter flow arrangement gas flow paths thereof;

FIG. 2 is a transverse cross-sectional view through a representative housing of an illustrative regenerator apparatus, and showing the rotor body in end elevational view;

FIG. 3 is an elevational side view representative of one form of rotor body manufactured by the present method;

FIG. 4 is an elevational detail of one form of ribbed annular plate member, which plates are assembled in plural sequential layers to comprise one of the specie embodiments of a ceramic rotor body;

FIG. 5 is an elevational detail view of a pair of rollers for calendering or extruding a media web having a specific tapered cross-section;

FIG. 12 is a still further perspective view showing a still further modified process and some apparatus for manufacturing one form of rotor body;

FIG. 13 is a fragmentary perspective detail view of a modified form of one of the rotor disc members;

FIGS. 14 and 15 are fragmentary outer edge views of different forms of the tapered honeycomb gas flow passages which may be formed for different species of rotor bodies;

FIG. 16 is a top plan semi-diagrammatic view representative of a still further, more preferred processes for manufacturing one of the more preferred forms of the ceramic material rotor body;

FIG. 17 is an enlarged scale perspective view better showing some of the details of some illustrative manufacturing apparatus as used in the process of FIG. 16; and FIG. 18 is a perspective detail view of a tapered die roller useful in embossing webs used in manufacturing a species of rotor body.

DESCRIPTION OF PREFERRED EMBODIMENTS

Figures 6, 7:
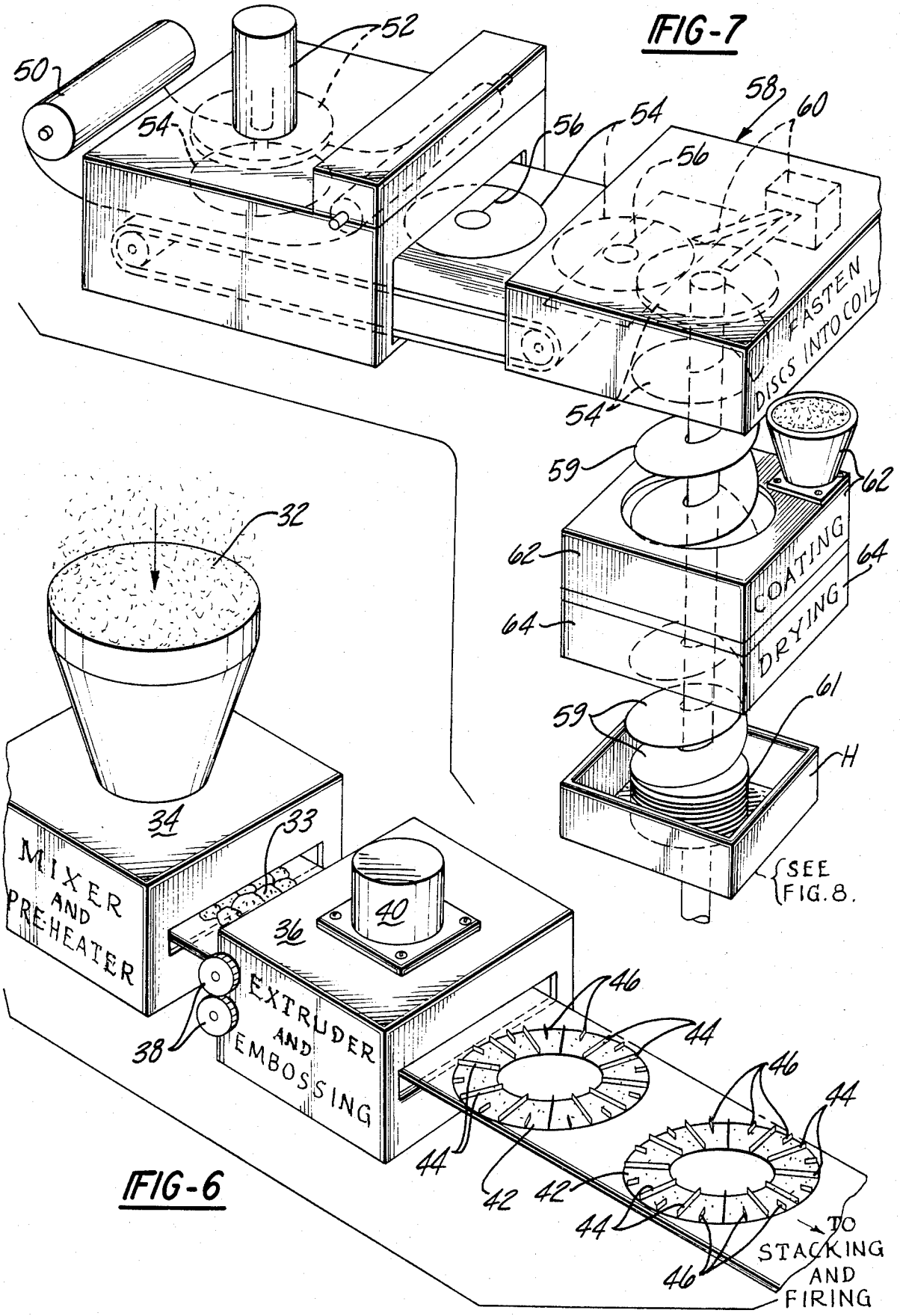
FIG. 6 is a fragmentary diarammatic perspective view representative of part of another of the manufacturing processes hereof.
FIG. 7 is another perspective diagrammatic view representative of part of one of the manufacturing processes hereof.

Beginning with the first two views of FIGS. 1 and 2, a radial flow rotor body is designated generally by the reference number 10. Body 10, which is made in accordance with one or more of the processes to be described hereinafter, is shown in semi-schematic association with a housing apparatus 12 and with suitable sealing means 14, neither of the latter items constituting any points of novelty of the present invention. Directional rotation of the rotor is indicated by the arrow 16.

The exemplified gas flow through the rotor body 10 in FIG. 1 is of a counterflow arrangement. That is, the inlet 18 for the fluid or cold air to be preheated, denoted by arrow 18*a*, lies adjacent to the outlet 20 for the residual partially-cooled exhaust gases, denoted by arrow 20*a*. The cooler or cold gas side 18 is separated from the warmer or hot gas side 20 by the division or guide plate 22. Each of the rotor bodies 10 comprises the aforementioned plurality of open-center sequential layers L of circular or near circular ceramic media, which layers collectively coact to form the plurality of radially oriented channels or gas fluid passageways P. Passageways P are of tapered or flared form, flaring from a narrower width at the inner circumferential edge to progressively greater circumferential width at the outer circumferential or radial portion thereof.

In FIG. 1, the schematic gas flow arrangement shows that the hot exhaust gases from the bladed section of the turbine, depicted by arrow 24, are directed into the housing 12, adjacent the outer periphery of rotor 10. In this arrangement this very hot exhaust gas is received within the larger cross-sectional portions of passageways P, and as it passes radially inward through the diminishing size passageway P, to contact and preheat the incoming cold air from the compressor, the gradual cooling would normally tend to decrease the flow velocity and to generate a noticeable pressure drop. However, due to the gradually diminishing cross-section of the passageways, a more uniform velocity is maintained which also inherently should decrease the pressure drop across the rotor body. In this manner, the efficiency of the regenerator apparatus is increased. As the rotor 10 continues to rotate, the partially cooled exhaust gases exit outlet 20 in the direction of arrow 20*a*. The preheated cooler air from the compressor, arrow 18*a*, is progressively warmed, traveling radially outwardly through passageways P from the cooler inner portion, and prgressively warming up and expanding as it travels through the gradually flaring or widening passageways P. Thereafter, this preheated air is directed to the combustor, as indicated by arrow 26. Thus, this preheated air leading to the combustor reaches a much higher temperature as a benefit of this counterflow arrangement. Further because the hottest region of the incoming air flow is the same region that is exposed to the hottest portion of the exhaust, that is, the outer circumference of the rotor body. With the hottest portion of each flow on the outer circumference, and the coldest on the inner circumference, the temperature gradient or discontinuity is not as great. Therefore the thermal stress to which the rotor body is subjected is reduced as it rotates and alternates between exposure to the incoming air and exhaust gas. This also tends to put the outer surface of the rotor in circumferential compression. The compressive stress impedes the propagation of outside cracks or damage into the rotor body. Radial tension generated in the rotor body advantageously lies along the radial ribs or plies of the construction. Other novel facets to be described hereinafter will be seen to contribute to providing increased strength factors to better combat both radial and circumferential tensions, including the fused assembly.

As will be discussed hereinafter, the non-uniform size of the tapered channel or passageway P can be offset in the corrugation or embossing facet of the manufacturing procedure. This can be achieved by using a non-uniform coating of the ceramic media, that is, keeping it thinner at the inner circumferential edge, and thickest at the outermost circumferential edge. These and similar features are illustrated at least in part by the drawing figures 4, 5, 9, 10, 13, and partially in 17 and 18. By so using the thinnest coating on the inside edge, the channel size would be proportionally greater or more open, whereas using a progressively thicker coating at the outside edge tends to better strengthen not only the outer edge, but also the related intermediate areas thereof.

Referring again to FIGS. 2 and 3, the rotor body may be provided with any suitable means to effect rotation thereof. While such means may include some form of end shafts (not shown) on the axis 28—28, a more preferred means may include peripheral drive gear means such as the gear 30 shown at the right end of FIG. 3, to effect its rotation about the axis 28—28.

Reference is now made to FIG. 6 which is a fragmentary perspective view representative of one of the manufacturing processes hereof. A ceramic-binder mixture of appropriate ceramic forming ingredients designated generally at 32 is effected within the mixer and preheater station 34. Materials of greatest current interest are magnesium alumina silicate (MAS), lithium alumina silicate (LAS), alumina silicate (AS), silicon nitride ($Si_3N_4$), and silicon carbide (SiC). This list includes the group consisting of cordierite ceramic material and mullite ceramic material such as disclosed in U.S. Pat. No. 4,340,403. The selected ceramic-forming ingredients are intermixed together with suitable binder material, such as a thermoplastic, carbowax, other carbon base material to facilitate burn-up when subjected to a high temperature firing procedure. It is known that clay talc mineral base compositions have been prepared previously by blending kaolin and talc powders together with high purity alumina or silica powders to make up a suitable cordierite composition, plus the addition of other additives to contribute to low thermal expansion ceramic material. It is preferred to avoid compositions which may result in porous character ceramic material or media mixture.

From the mixer-preheater-station, the ceramic-binder mixture 33, which preferably is of a generally malleable, deformable semi-plastic character, is suitably conveyed to an extruder and embossing station 36. The mixture 33 is suitably rolled or calendered or extruded as between a pair of rollers, not shown, but which rollers may be driven by gear or drive wheel means 38. Combined die cutting and embossing means, generally designated at 40 in association with said station 36, effect a die-stamping and embossing of the rolled flat ceramic-mixture media web. As seen in FIG. 6, this step produces a plurality of the open-center disc elements 42 of predetermined thickness. The embossing die press portion 40 forms a plurality of uniformly circumferentially spaced, radially directed, upstanding rib elements 44, with the remainder being of the aforesaid basically flat disc form, at least for some embodiments. For other potential modified embodiments, reference is made to FIG. 13, wherein the disc body may be pressed so as to have a thinner thickness at the inner peripheral or circumferential edge, and have progressively increasing thickness toward the outermost circumferential edge. With continued reference to FIG. 13, although the rib elements 44*a* may be of basically uniform thickness in the radial direction, preferably several of the other ribs 44*b* are of progressively increased width in their extended radial direction from the inner to outer circumferential edges. The modified disc element 42' shown in FIG. 4, may have all its upstanding ribs 44*c* of the progressively wider form similar to those ribs 44*b* in FIG. 13.

Reverting back to FIG. 6, depending upon the amount of circumferential spacing between the ribs 44, it is contemplated that some embodiments may be provided with additional partial radial rib segments 46. These rib segments 46 are of the same upright height projection as ribs 44, but are extensively foreshortened in the radial direction, as shown.

The formed plurality of disc elements 42 are then aptly conveyed to a suitable stacking and firing station, where the predetermined number of the disc elements are layer stacked with the ribs of respective sequential layers being respectively axially or longitudinally and radially aligned, such as the form shown in FIG. 3. A separate flat, nonribbed disc member 48 having the same inner and outer peripheries is affixed to the end of the predetermined stack (FIG. 3) or sequential layers to complete a given rotor body. The aforesaid axial or longitudinal and radial alignment of the respective plate ribs assures a much stronger rotor body assembly in both the unfired and fired sates thereof. Upon firing, the assembled ceramic-binder layers and any end disc elements become integrally fused into a strong rigid unitary body. In lieu of disc member 48, the endmost ribbed layer can be filled between the radial ribs with a similar semi-plastic state or slurry mixture of at least similar ceramic material to provide a greater strength end member upon firing. This would also provide a suitable support surface for attachment of a ring drive gear 30.

Reference is next made to the modified process portions shown in FIG. 7. The procedure herein includes a supply roll of low ash thin paper 50 which constitutes a media web from which via die cut means 52 a suitable plurality of open center paper discs 54 are cut out having a substantially circular form with inner and outer peripheral edges. A single cut line 56 extends radially between the inner and outer peripheral edges of each paper disc. The discs are suitably transported to the next station 58 which has suitable means 60 for both separating the cut edges, and for suitably fastening together one cut edge of one disc with an oppositely adjacent cut edge of the subsequently following cut disc. In this manner or by other suitable means, the cut discs are assembled into a continuous helical form web 59 which is fed by suitable means to be collected into a substantially uniform helical web supply 61. For some forms of the invention, the paper may be left uncoated and used in interleaved combination with another similar helical web of ceramic coated media. For other forms, the helically formed web 59 is passed through a suitable coating station 62 where either a uniform or non-uniform layer of ceramic-binder mixture may be selectively applied. This coated web media is then subjected to a suitable drying procedure, as at station 64, to achieve at least a partial drying of the web media prior to his final helical repose at 61, as within supply hopper means H. The drying should be sufficient to prevent undue premature sticking together of adjacent layers of the helical web supply before it can be further processed.

Figures 8, 9, 10, 11:
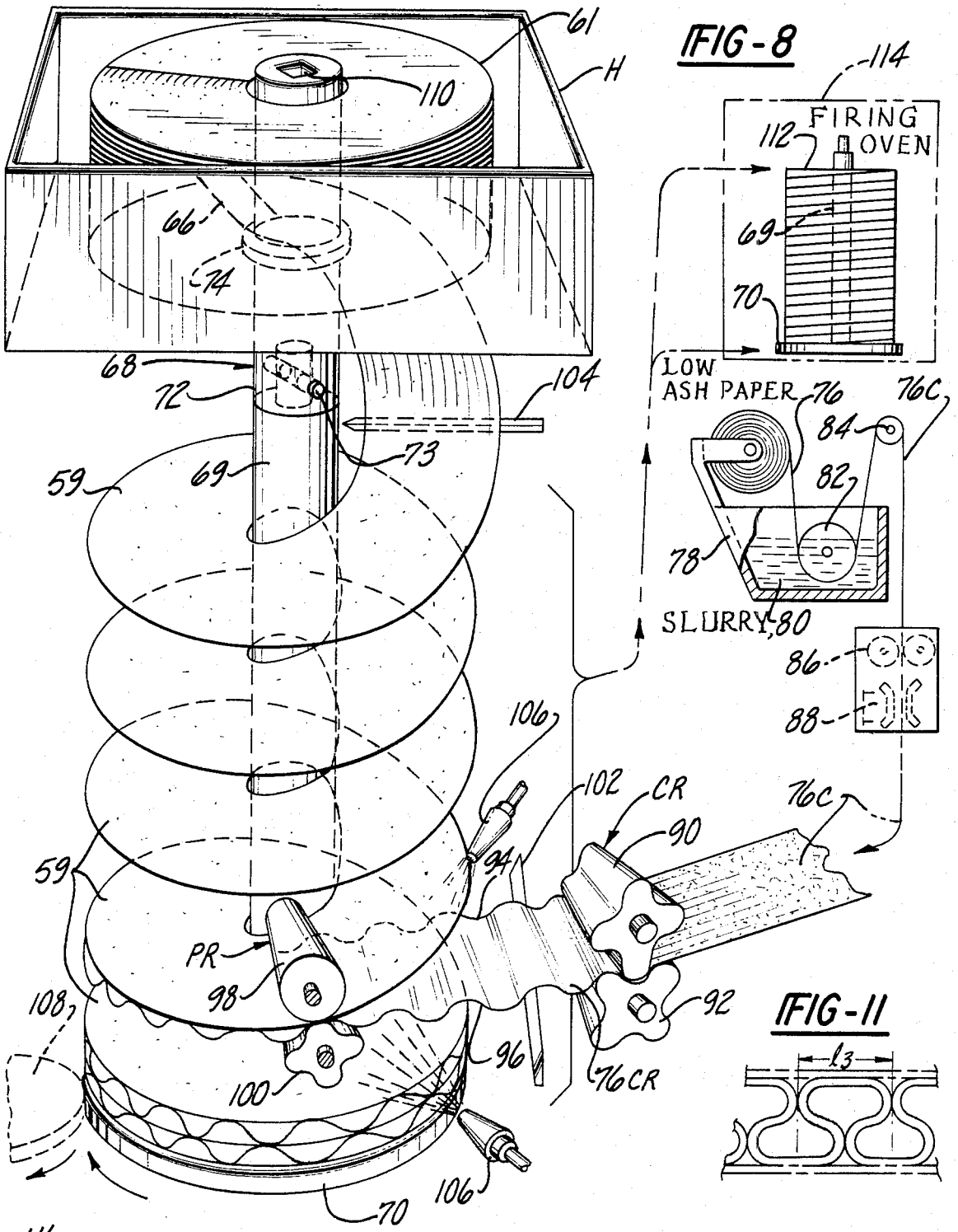
FIG. 8 is a further semi-diagrammatic perspective view of what may be considered a continuation of the apparatus and method portions shown in FIG. 7.
FIG. 9 is a smaller scale perspective view of an ilustrative ingredient-mixer and extruder mechanism for extruding a ceramic-binder mixture in a ceramic-media web having a tapered transverse cross-section.
FIGS. 10 and 11, on the same sheet with FIGS. 8 and 9, represent various specie details which are present in the partially shown respective outer and inner circumferential portions of some corrugated forms of the ceramic media web which form the rotor bodies hereof.

To continue this method for manufacturing, reference is next made to FIG. 8, wherein the coated web supply 61 is suitably supported in the hopper means H. The free end of the helical supply web 59 is downwardly fed through slot 66 in the helically shown manner, being guided downwardly about rotatable center mandrel means 68 onto the upper surface of a mandrel support plate 70. The mandrel means 68 may comprise a multiple-part assembly including a lowermost shaft section 69 connected to plate 70, and an upper shaft section 72 with suitable means for imparting feed rotation to the web supply 61 in the hopper H. The means for imparting rotation to the web supply 61 may be of leaf spring means (not shown) disposed closely adjacent to and operatively connected with the shaft section 72 and within the open center of the web supply so as to frictionally engage same and impart feed rotation. Alternatively, the web supply 61 may seat upon a shallow annular collar 74 (FIG. 8), whose rotation with the shaft will impart the necessary rotation to help feed the helical web downwardly as stated, and essentially in a continuous manner.

Concerning the multipart aspect of the mandrel means 68, the lowermost portion 69 and uppermost portion 72 may be suitably detachably connected as by transverse pull pin 73. As will be described more hereinafter, this arrangement will enable the helically built-up interleaved media webs, after their severance step, to be transported to a firing station. Replaceable sub-assemblies of other mandrel plates and lower shaft portions are used to facilitate continuing formation of subsequent rotor bodies.

Another web material to be interleaved with web 59, following its preparation, and to be built up into helically interleaved relation therewith will now be described in conjunction with this FIG. 8. A thin carrier media such as a supply roll of low ash paper 76 is rotatively supported adjacently over a slurry bath tank 78. The initially straight-sided carrier paper web is fed through a ceramic material slurry bath media 80, via roller 82 or the like, where it is coated on both sides with the ceramic mixture slurry material. Upon leaving the bath 78,80, the coated web **76*c* may pass over idler roller means 84, then between suitable calendering or smoothing roller means 86, and then through suitable drying station means such as denoted at 88, adjacent the calendering means 86. The coated web 76*c*** preferably is only sufficiently dried to render the impregnated paper carrier and its ceramic material coating into a readily deformable, semi-plastic character in preparation for its next stage treatment through the crimping roller means CR.

As shown in FIG. 8, crimping roller means CR include a pair of tapered coacting crimping or corrugating rollers 90,92. The rollers will have a suitable number of alternate convex-concave portions, such as the quad form illustrated, and will be of proper configuration at both the outermost and tapered innermost end portions so as to impart a predetermined definite tapered corrugated pattern to the web portion 76CR. The preferred corrugated pattern will form a series of alternating tapered grooves in a manner which assures subsantially the same depth or height both at the innermost edge 94 and at the outermost edge 96. This can be better seen in the detail FIG. 10, wherein h represents the common height between adjacent layers of the aforesaid helical web media 59. Because the coated web **76*c* may be made to have a non-uniform tapered cross-section, such as achieved by passing it through the slightly canted roller means 86 as shown in FIG. 5, or as a result of the extrusion form shown in FIG. 9, the outermost radial edge 96 of the crimped web 76CR in FIG. 10 can be seen to be somewhat thicker than the innermost radial edge 94, which is shown in dotted outline. The FIG. 10 depiction also illustrates the exemplary different shaped character and respective wavelength $\mathbf{1}_1$ and $\mathbf{1}_2$ between adjacent corrugations at the respective outer and inner edges of the crimped media web 76CR. This also represents that the developed distance of the web media between the respective centerlines is also effectively the same distance. The tapered crimping or corrugating step thus will effectively impart a beginning arcuate path to the media web shortly after leaving rollers CR. This effect may be better seen in conjunction with FIG. 16** relative to a still different embodiment yet to be described hereinafter.

Strategically interposed between the crimping rollers CR and the collecting-support mandrel plate 70, there are preferably another set of pressing rollers PR, which also are of similar tapered form. Rollers PR not only will impart further arcuate travel to the pressed-together media webs as they are helically collected and wound onto said support mandrel, but also will affect preattachment of the flat and corrugated media webs prior to being helically collected. Rollers PR include an upper smooth surface roller 98, and a lower corrugated type roller 100, which may be a duplication of one of rollers 90 or 92. These are spaced apart just enough to assure a good contact and bond between flat surfaced media web 59, and the crests or high portions of the corrugated media 76CR, as they pass between these pressing rollers. Naturally the distance between the crimping rollers CR and the pressing rollers PR preferably will be a minimal predetermined number of wavelengths to assure proper registry of a crimped portion of the web media with the correspondingly configured portion of pressure roller 100.

Appropriate web cutting means, such as knife bar means 102 and 104, are suitably mounted at strategic positions so as to effectively cut off the respective media webs at predetermined times when a predetermined overall length of a the co-leaved or interleaved media webs has been attained.

During the helically interleaving formation . and buildup of the rotor body, in order to assist in bonding the layers together it may be desirable to use spray nozzle means 106 to effectively dispense a supplemental bonding agent, such as an adhesive or solvent onto the ready-to-be-contacted areas of the web media, as shown in FIG. 8.

Rotation of mandrel means 68 may be achieved in any suitable manner, such as by a frictionally engagable drive wheel 108, shown fragmentarily in FIG. 8, adaptable to be selectively engagable and disengagable with the periphery of bottom support plate 70. Other means (not shown) may be used to rotate the shafts, such as via square recess 110 in the upper shaft end of shaft 72.

While no detailed manner of supporting the respective crimping roller means CR and the pressing roller means PR have been or need to be shown, it is understood that appropriately designed structure will include means to permit said roller means to be movable or floatingly mounted, together with nozzle means 106. This will enable them to move vertically along with the progressive buildup of the sequential layers of the rotor body upon the mandrel means. Other means not shown, such as coaxially arranged threaded interconnections between lowermost and uppermost mandrel shaft portions can be evolved as alternate means for helping to effect rotor manufacture and buildup thereof upon the mandrel means. In such a potential latter-suggested manner, it is conceivable for the buildup to occur starting with mandrel support in an elevated position and working its way downward upon relative rotation of coacting threaded shaft means, or the like.

Continuing relative to FIG. 8, upon the completion of the buildup of the predetermined number of sequential helical layers, said knife means 102 and 104 are activated, and the pull pin 73 is withdrawn to release the subassembly of lower mandrel shaft portion 69 and its support plate 70. A new such subassembly is reattached to the upper shaft section 72 to permit continuing manufacture of rotor bodies. The detached subassembly with its unfired rotor body buildup, is suitably provided with a top plate means 112 (see firing oven station) prior to its being installed within the firing oven 114. Like the previously mentioned alternative to the end disc member 48, in lieu of top plate means 112, the endmost corrugated radial passageways of one or both ends can be filled with a similar semi-plastic state of at least similar ceramic material, such as shown at 113 in the fragmentary FIG. 15. This will provide a greater strength end member both before and after firing, and serve as a suitable support surface for attachment of a ring drive gear or the like. After being subjected for a predetermined time period to the elevated firing temperatures within the oven 114, the rotor body is deemed to be in useful fired condition. It is understood that during the firing procedures, the low ash paper carrier media and other carbon-base binders, thermoplastic materials, and the like, are essentially completely burned out, thus desirably leaving only the fire-hardened ceramic rotor body in a unitary fused assembly.

FIG. 9 has been previously only briefly mentioned. It generally represents apparatus which includes a suitable ingredient mixer and preheater station 116, and extrusion means 118, of which the latter includes an extrusion nozzle 120. Nozzle 120 is seen to be capable of generating an extruded media web 122 which is characterized by a gradually tapered cross-sectional thickness.

FIG. 11 is a representative fragmentary detail showing of a still further potential innermost edge design arrangement for the convoluted ceramic media web having a tighter or smaller inner radius. The distance denoted $1_3$ generally corresponds to the distance $1_2$ in FIG. 10.

Proceeding to the modified process exemplified in FIG. 12, a dual compartmented hopper means includes a first hopper H1 and a second hopper H2, in which are supported respective supplies of helically prepared media webs W1 and W2. The media web W1 is of basically flat character, whereas the media web W2 is of precorrugated character. Both media web supplies are preferably precoated with a suitable ceramic-binder slurry mixture, such as described hereinabove relative to the embodiment of FIG. 8. The left hand hopper H1, and its web supply W1 function the same way in conjunction with the same type center post and mandrel means 68' as that designated 68 in FIG. 8, and need not be redescribed herein. Primed reference numerals used in the left hand portion of FIG. 12 correspond to their unprimed correspondingly numbered counterparts in the previously described FIG. 8 embodiment. The right hand hopper and web supply W2 also function in a similar self-evident manner, although its inclined guide mandrel 68" is not connected at its lower end with any plate member corresponding to the support plate 70, thus allowing the web to freely pass over the lower end during the interleaving functioning of building the rotor body. The right-hand side guide mandrel 68" may remain stationary or it may be rotatively driven as by means of a universal type joint 71 to connect it with a drive shaft 72", shown in broken lines in the right hand web supply W2. Other suitable means may be used to generate appropriate feed of the respective media webs to achieve the desired interleaving sequential layer build-up of the rotor body.

When both media web supplies W1 and W2 are precoated with the ceramic-binder material, a resultant rotor body may have an outside edge pattern as depicted, and better seen in the fragmentary detail of FIG. 14. This preferred arrangement, which results in a potentially overall stronger rotor body, is one where the crests of one layer abut the crests or are aligned so that they would abut therewith except for the intervening flat media layer 59'.

In the event a larger or more open relative size passageway is desired, then the flat or uncrimped media web 59' preferably is left uncoated with the ceramic material; that is, it may comprise a carbon base media such as a low ash residue paper which will burn out completely. This low ash paper media is designated at 59" in FIG. 15, being partially shown in dashed or phantom lines. In the same FIG. 15, the greater resultant size channels can be readily discerned following the burn out accompanying the firing procedure. A further variation hereof is to use only a precrimped media supply in a manner which results in the type of edge pattern shown in FIG. 15, without the necessity to use an intermediate flat web media.

FIG. 13 was previously discussed hereinabove, describing and illustrating various forms of the radial rib elements. These rib elements may be embossed by use of suitably designed embossing rollers, two different ones being represented respectively in FIGS. 17 and 18.

The last but one of the more preferred method embodiments will now be described relative to the exemplary drawings FIGS. 16 and 17. An exemplary equipment arrangement useful to practice this method is depicted in semi-schematic top plan view in FIG. 16. Starting in the upper left-hand portion thereof, a suitable ingredient mixer portion is designated 122. The mixture of ceramic-producing ingredients is such that it lends itself to being compressed, transported and extruded within screw-type extruder section 124 which terminates preferably in a slightly arcuate (in top plan view) extrusion nozzle 126. The extruded media web 128 leaves the nozzle in a slightly arcuate path, passing between tapered embossing roller means 130, comprising upper special fluted roller 132 and the lower tapered but smooth surfaced roller 134 (FIG. 17). The specially tapered ridge and groove portions of the roller 132 assure production of an embossed media web of the type shown; that is, it produces radially tapered grooves 136 separated by upstanding narrower tapered rib elements 138. The tapered lower smooth embossing roller 134 assures a continuous smooth and generally flat undersurface to the media web. The tapered form of these coacting rollers generates an embossed media web which tends to follow a tighter arcuate pathway, which media is received upon a generally circular and rotatable support plate 140. Plate 140 is initially in the dotted line elevated position when it first starts to receive the extruded media web. The plate 140 has a center aperture which has a thread portion adapted to cooperatively mate with the helical thread portion 142 of an upright spindle member 144. Selectively engagable drive means 146 are adapted to engage and rotatively drive plate 140 so that it progressively moves down the threaded spindle while helically collecting sequential ceramic media layers. It is understood that the screw thread pitch of the threads 142 on spindle member 144 should effectively match the pitch of the helical sequential layers which help comprise the rotor body.

A plurality of separate support plates 140 may be similarly supported upon a corresponding plurality of support means 148, such as in the spidered arm arrangement of FIG. 16. Upon completion of the building up of the predetermined number of layers, the media web is severed by suitably timed knife or cutter means 150 (FIG. 16), the spidered arm support is programed to move the completed unfired rotor body from the building station in a clockwise manner to a transfer station 152, while a new spindle and support plate automatically move into the just-vacated building position where a new rotor body is built-up in the same repetitive manner. At the transfer station 152, each unfired completed rotor body is then transferred into a firing station 154 where the body can be fired into a fused usable state. A continuous manufacturing system is established.

FIG. 17 shows some of the details of FIG. 16 in an enlarged clarified manner. Rotatable support plate 140 is shown as having an outer rim of gear teeth **140*a* adapted to be drivingly engaged by mating spline-like teeth 146*t* on the elongated drive gear body 146*b*. Drive gear 146*b* is rotatably supported on suitable pivotal support arm means 156, so as to be selectively engagable/disengagable with the respective gear teeth 140*a* on the respective support plates 140. The gear body 146*b* is of vertically elongated form so as to be engagable throughout the complete helical building cycle of the rotor body media layers. It is apparent that frictionally engagable surfaces may replace the respective gear drive surfaces on members 140 and 146*b*. As shown, the gear body 146*b* may be driven via a pinion gear 158 affixed to the upper end thereof and suitable drive chain means 160** all programmed for proper sequential operating procedure.

The foregoing detailed descriptions make it apparent that novelly useful methods have been devised for manufacturing the novelly constructed rotor bodies of the types described. In addition to the various embodiments already disclosed and suggested, still other changes and variation may be made which involve more freedom of design to adjust gas passageway or channel size for accommodating changes in volume and pressure of the gas fluid as it heats and cools during its travel through the regenerator apparatus. Such design factors include varying of the passage-separating wall thicknesses, the potential progressive change in body wall thickness toward its outer periphery, and changes in inner and outer rotor body radii. Additionally, proper computations can be made to assure that wavelenth or distance between crest portions of ribbed or corrugated media will be such as to assure substantial proper phase registry of sequential layers so that crest areas mate substantially with opposite crest areas throughout the build up manufacturing, as shown better in FIGS. 14 and 15. One way believed to solve this is to equate the number of corrugations to an integer, donated n, and wherein the number of corrugations needed to assure proper phase registry is the interger $\pm\frac{1}{2}$ of the selected corrugation wavelength.

In conclusion, the presently described inventive facets of this disclosure are not to be given restrictive interpretation based only upon the illustrative examples and drawing figures. Because other changes and modifications may be made by those skilled in the art to the methods and articles disclosed without departing from the spirit and inventive concepts, reference should be made to the appended claims for a definition of the scope of claimed subject matter hereof.

What is claimed is:

1. A unitary ceramic radial flow heat exchange regenerator, the regenerator having a generally toroidal configuration with a plurality of radially extending passages, the passages having a relatively smaller cross sectional area at the inner portion of the toroidal structure and a relatively larger surface area at the outer surface of the regenerator including: a continuous helically wound strip of ceramic material having a substantially uniform cross section, the edges of the strip being substantially the same length, the strip being formed in a nonuniform corrugated structure so that the innermost portion of the strip has a first wave structure and the outermost portion of the strip has a second wave structure, the first wave structure having a shorter wave length than the second wave structure, the upper and lower positions of the first and second wave structures lying in the same plane and the adjacent wraps of the strip having a phase difference of one-half wave length so that the ridges of one wrap are in registry with the furrows of the adjacent wrap; and two annular ceramic sealing caps, one disposed on each end of the regenerator.

2. The ceramic regenerator of claim 1 further including a thin strip of flat ceramic material helically wound between the wraps of the corrugated ceramic material to divide the chambers formed by adjacent wraps.

* * * * *